US006195837B1

(12) United States Patent
Vanderlinden

(10) Patent No.: US 6,195,837 B1
(45) Date of Patent: Mar. 6, 2001

(54) DEBRIS SUCTIONING AND SEPARATING APPARATUS FOR USE IN A SURFACE SWEEPING VEHICLE HAVING A MECHANICAL DEBRIS ELEVATOR

(76) Inventor: Roger P. Vanderlinden, 73 Sherman Ave. S., Hamilton (CA), L8M 2P8

( * ) Notice: Subject to any disclaimer, the term of this patent is extended or adjusted under 35 U.S.C. 154(b) by 0 days.

(21) Appl. No.: 09/253,747

(22) Filed: Feb. 22, 1999

(51) Int. Cl.[7] ..... E01H 1/08

(52) U.S. Cl. ..... 15/348; 15/340.3; 15/340.4; 15/349

(58) Field of Search ..... 15/340.3, 340.4, 15/348, 349

(56) References Cited

U.S. PATENT DOCUMENTS

| | | | | |
|---|---|---|---|---|
| 913,460 | * | 2/1909 | Bishop | 15/340.3 |
| 949,069 | * | 2/1910 | Grimwood | 15/340.3 |
| 1,071,301 | * | 8/1913 | Diserens | 15/348 X |
| 1,085,676 | * | 2/1914 | Finch | 15/348 X |
| 1,087,588 | * | 2/1914 | Killman | 15/349 X |
| 1,228,773 | * | 6/1917 | Hartman | 15/348 |
| 1,369,118 | * | 2/1921 | McDougall et al. | 15/340.3 X |
| 1,546,441 | * | 7/1925 | Frayer | 15/348 |
| 1,560,612 | * | 11/1925 | Sims | 15/340.3 X |
| 1,610,119 | * | 12/1926 | Butler | 15/348 |
| 1,861,681 | * | 6/1932 | Birdsall | 15/340.3 |
| 3,639,940 | * | 2/1972 | Carlson et al. | 15/349 X |
| 4,561,145 | * | 12/1985 | Latham | 15/348 X |
| 5,303,448 | * | 4/1994 | Hennessey et al. | 15/349 X |
| 5,588,179 | * | 12/1996 | Bargiel et al. | 15/349 |
| 5,794,304 | * | 8/1998 | Ritter | 15/340.3 X |

* cited by examiner

*Primary Examiner*—Chris K. Moore

(57) ABSTRACT

A debris suctioning and separating apparatus for use in a surface sweeping vehicle having an elongate cylindrically-shaped rotating sweeping broom, a debris receiving and retaining hopper, and a debris conveying mechanism to receive debris from said rotating sweeping broom and convey it to said hopper, comprises a debris separator that is mounted on the surface sweeping vehicle exteriorly to the hopper and has an air inlet for receiving debrisladen air into the debris separator, an air outlet for exhausting separated air from the debris separator, and a debris release outlet for selectively releasing separated debris from the debris separator. A fan is operatively mounted at the air outlet of the debris separator, to draw the debris-laden air through the air inlet and into the debris separator, and to exhaust the separated air from the debris separator to ambient surroundings. A valve is operatively mounted on the debris separator at the debris release outlet, to effect the controlled flow-restricted release from the debris separator of the separated and captured debris, and to preclude the ingress of air and debris into the debris separator through the debris release outlet. Debris is separated from the debris-laden air drawn through said air inlet and into the debris separator, during the operation of the rotating sweeping broom and the debris conveying mechanism.

28 Claims, 4 Drawing Sheets

DEBRIS SUCTIONING AND SEPARATING APPARATUS FOR USE IN A SURFACE SWEEPING VEHICLE HAVING A MECHANICAL DEBRIS ELEVATOR

FIELD OF THE INVENTION

The present invention relates to surface sweeping vehicles such as street sweepers and factory sweepers, and more particularly to such surface cleaning vehicles that employ sweeping brooms.

BACKGROUND OF THE INVENTION

The removal of dirt and debris from streets, parking lots, airport runways, factory floors, and other similar paved surfaces, through the use of various types of street sweeping vehicles or factory sweeping vehicles, as may be the case, has been known for many years. As is well known in the industry, street sweeping vehicles, also known as mechanical street sweepers, employ a sweeping broom to remove dirt and debris from a surface and a conveying type elevating mechanism to lift the debris several feet up and deposit it into a hopper. Also, as is well known in the industry, factory sweeping vehicles, also known as factory sweepers, employ a sweeping broom to remove dirt and debris from a surface and sweep the debris several feet up and deposit it into a hopper. For the sake of brevity, clarity and simplicity, such vehicles will be generally referred to in this document as surface sweeping vehicles.

In surface sweeping vehicles, a pair of counter-rotating brushes sweep dirt and debris inwardly to underneath the central area of the sweeper and an elongate cylindrically-shaped sweeping broom that rotates about a horizontal axis sweeps the dirt and debris forward up and onto a conveyor. The conveyor deposits the dirt and debris into a hopper for subsequent controlled dumping from the hopper. Such mechanical broom sweepers can remove large amounts of dirt and debris from a paved surface quite quickly and can generally remove large pieces of debris quite readily. However, they cannot contain fine particulate matter that has become airborne, without the use of water for dust suppression. The use of water is undesirable as it creates two problems. A covering of wet dirt remains on the surface behind the surface sweeping vehicle. During the warm months, when the water in this wet dirt evaporates, significant amounts of dried small particulate matter from the wet dirt become air borne. Also, water cannot be used in cold winter months because the water tends to freeze on the surface being swept, thus creating unsafe conditions, and tends to freeze in tank, lines and water pipes.

It is widely accepted in the industry that the containment of dust generated during the street cleaning operation is extremely difficult, especially the containment of dust having a particle size under ten microns, without using water. Virtually all street sweepers—that is to say mechanical street sweeping vehicles employing sweeping brooms as the primary means for removing dirt and debris from a road surface—have an inherent problem with containment of dust, especially dust having a particle size under ten microns. With street sweeping vehicles, it is common to use water for dust suppression. However, water can be used only during warm weather when the water will not freeze, and thus, such sweepers are often avoided altogether in many colder climates. Moreover, after a wet road surface has been swept by a sweeping broom, the wet road surface dries and leaves behind a residual fine dust that ultimately becomes airborne, commonly in the form of very fine dust having a particle size under ten microns, which is highly unacceptable.

Recently, it has become increasingly important for environmental reasons to not just fully remove dirt and debris during a street cleaning operation, but to remove dust and other particulate matter, especially particles less than about ten microns. In many jurisdictions, there are strict environmental laws pertaining to the removal and containment, during a street cleaning operation, of particulate matter having a size of less than ten microns, which is essentially breathable particulate.

Some mechanical type street sweeping vehicles employ a rotating broom that throws dirt and debris into a "squeegee" type elevator for deposit into a hopper. The elevator overthrows the dirt and debris into a hopper behind the elevator. The filtration system is located within the hopper, directly over the entire volume of the hopper. Air from the hopper is drawn upwardly through the filters, thus always creating a negative pressure within the hopper, elevator, and sweeping broom areas, and is expelled through a small additional filter to the atmosphere. During use, the filters trap dust and fine debris from the air stream created by the fan. A vibrating mechanism shakes the filters to shake loose the trapped dust and debris and deposit it into the hopper. However, since the air stream is continuously flowing at an aggressive pace through the filters, the trapped dust and debris can tend to clog the filters. In order to properly clear the filters completely, the sweeping operation must be stopped, and the filters vibrated until they are clear. Often, additional cleaning and maintenance of the filters may be necessary.

Moreover, due to the inherent positioning of the filter in the hopper, such filters are susceptible to moisture carryover, which can lead to clogging of the filters, thereby possibly causing cessation of dust control.

The only mechanical street sweeping vehicles that can employ an auxiliary debris suction hose to facilitate the supplemental suctioning of debris, must first stop their street sweeping operation due to their inherent design and operating characteristics.

It is an object of the present invention to provide a dust controlling apparatus for use in a mechanical surface sweeping vehicle, which dust controlling apparatus substantially precludes dust that is generated during a street cleaning operation from being expelled to the atmosphere.

It is an object of the present invention to provide a dust controlling apparatus for use in a mechanical surface sweeping vehicle, which dust controlling apparatus substantially precludes dust that is generated during a street cleaning operation from being expelled to the atmosphere, without the use of water for dust suppression.

It is another object of the present invention to provide a dust controlling apparatus for use in a mechanical surface sweeping vehicle, which dust controlling apparatus substantially precludes dust that is generated during a street cleaning operation, and has a particle size of less than ten microns, from being expelled to the atmosphere.

It is a further object of the present invention to provide a dust controlling apparatus for use in a mechanical surface sweeping vehicle, which dust controlling apparatus substantially precludes dust that is generated during a street cleaning operation from being expelled to the atmosphere, during the cleaning in both wet and dry street conditions.

It is yet another object of the present invention to provide a surface sweeping vehicle that can suction dust and various forms of debris while sweeping a surface with a sweeping broom.

It is yet another object of the present invention to provide a surface sweeping vehicle having a dust and debris separator that does not become clogged with moist debris.

SUMMARY OF THE INVENTION

In accordance with one aspect of the present invention, there is provided a novel debris suctioning and separating apparatus for use in a surface sweeping vehicle having a surface cleaning means and a debris receiving and retaining hopper. The debris suctioning and separating apparatus comprises a debris separator means that is mounted on the surface sweeping vehicle and has an air inlet for receiving debris-laden air into the debris separator means, an air outlet for exhausting separated air from the debris separator means, and a debris release outlet for selectively releasing separated debris from the debris separator means. A fan means is operatively mounted at the air outlet of the debris separator means, to draw the debris-laden air through the air inlet and into the debris separator means, and to exhaust the separated air from the debris separator means to ambient surroundings. A valve means is operatively mounted on the debris separator means at the debris release outlet, to effect the controlled flow-restricted release from the debris separator means of the separated and captured debris, and to preclude the ingress of air and debris into the debris separator means through the debris release outlet. Debris is separated from the debris-laden air drawn through the air inlet and into the debris separator means, during the operation of the surface cleaning means.

In accordance with another aspect of the present invention, there is provided a novel debris suctioning and separating apparatus for use in a surface sweeping vehicle having a surface cleaning means, and a debris receiving and retaining. The debris suctioning and separating apparatus comprises a debris separator means mounted on the surface sweeping vehicle exteriorly to the hopper and has an air inlet for receiving debris-laden air into the debris separator means, an air outlet for exhausting separated air from the debris separator means, and means for selectively releasing separated debris from the debris separator means. A fan means is operatively mounted at the air outlet of the debris separator means, to draw the debris-laden air through the air inlet and into the debris separator means, and to exhaust the separated air from the debris separator means to ambient surroundings. Debris is separated from the debris-laden air drawn through the air inlet and into the debris separator means, during the operation of the surface cleaning means.

In accordance with yet another aspect of the present invention, there is provided a novel debris suctioning and separating apparatus for use in a surface sweeping vehicle having a surface cleaning means, a debris receiving and retaining hopper, and a debris conveying means to receive debris from the surface cleaning means and convey it to the hopper. The debris suctioning and separating apparatus comprises a debris separator means that is mounted on the surface sweeping vehicle and has an air inlet for receiving debris-laden air into the debris separator means, an air outlet for exhausting separated air from the debris separator means, and a debris release outlet for selectively releasing separated debris from the debris separator means. A fan means is operatively mounted at the air outlet of the debris separator means, to draw the debris-laden air through the air inlet and into the debris separator means, and to exhaust the separated air from the debris separator means to ambient surroundings. A valve means is operatively mounted on the debris separator means at the debris release outlet, to effect the controlled flow-restricted release from the debris separator means of the separated and captured debris, and to preclude the ingress of air and debris into the debris separator means through the debris release outlet. Debris is separated from the debris-laden air drawn through the air inlet and into the debris separator means, during the operation of the surface cleaning means and the debris conveying means.

In accordance with still another aspect of the present invention, there is provided a novel debris suctioning and separating apparatus for use in a surface sweeping vehicle having a surface cleaning means, a debris receiving and retaining hopper, and a debris conveying means to receive debris from the surface cleaning means and convey it to the hopper. The debris suctioning and separating apparatus comprises a debris separator means mounted on the surface sweeping vehicle exteriorly to the hopper and has an air inlet for receiving debris-laden air into the debris separator means, an air outlet for exhausting separated air from the debris separator means, and means for selectively releasing separated debris from the debris separator means. A fan means is operatively mounted at the air outlet of the debris separator means, to draw the debris-laden air through the air inlet and into the debris separator means, and to exhaust the separated air from the debris separator means to ambient surroundings. Debris is separated from the debris-laden air drawn through the air inlet and into the debris separator means, during the operation of the surface cleaning means and the debris conveying means.

Other advantages, features and characteristics of the present invention, as well as methods of operation and functions of related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the dust retaining apparatus according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
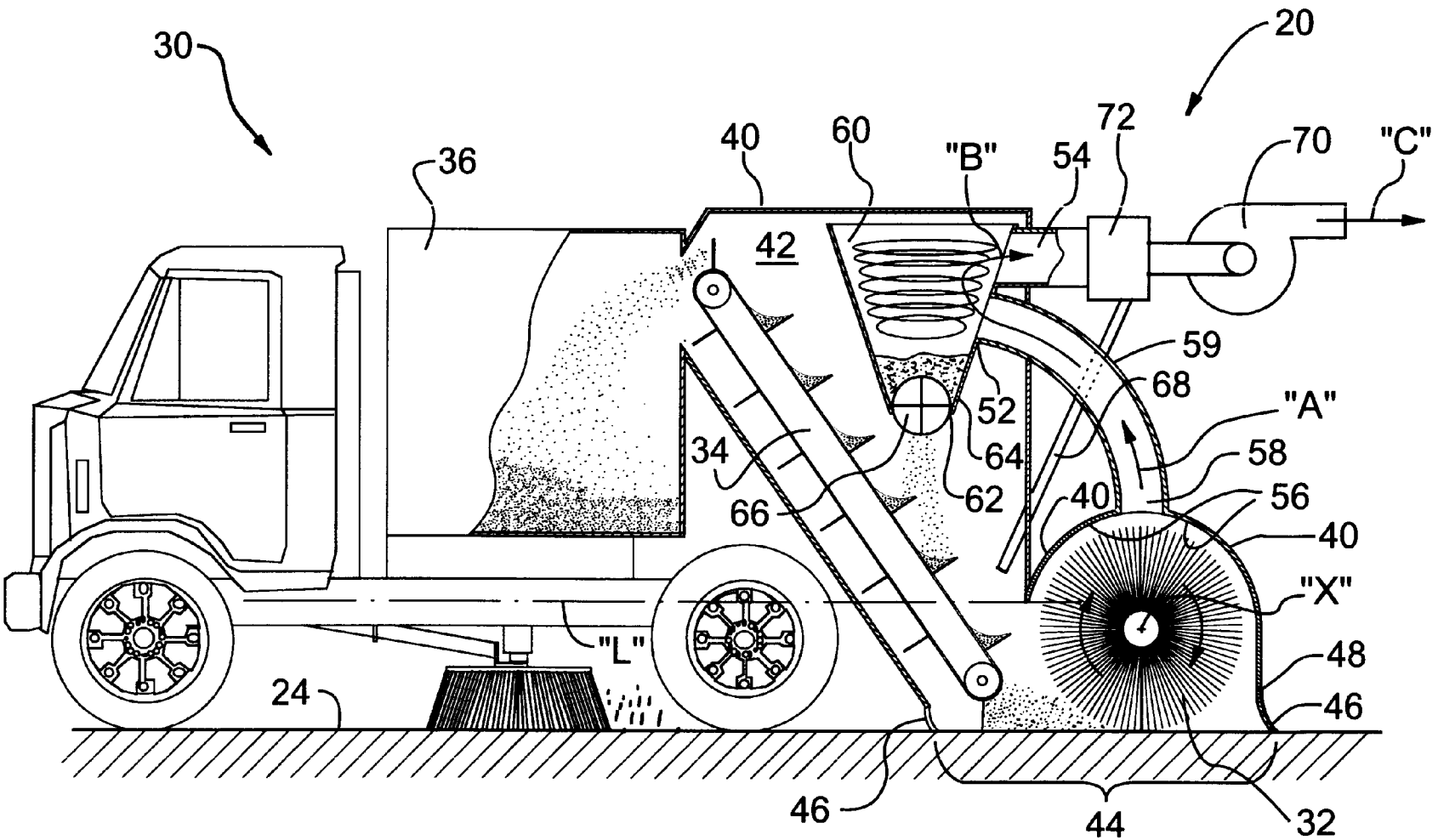
FIG. 1 is a side elevational view of a preferred embodiment of the debris suctioning and separating apparatus according to the present invention, installed on a surface sweeping vehicle, specifically on a mechanical sweeper, with a portion of the side of the surface sweeping vehicle removed for the sake of clarity.

Reference will now first be made to FIG. 1, which shows a preferred embodiment of the debris suctioning and separating apparatus of the present invention, as indicated by general reference numeral 20, for use in a surface sweeping vehicle, as indicated by general reference numeral 30. The surface cleaning vehicle 20 has a front end 21 and a back end 22 and a generally centrally disposed longitudinal axis "L" extending between said front and back ends 21,22. A surface cleaning means comprises an elongate cylindrically-shaped rotating sweeping broom 32 that is mounted on the surface sweeping vehicle 30 for rotation about a horizontal axis "X" oriented transversely to the length of the surface sweeping vehicle 30. The rotating sweeping broom 32 sweeps debris on a surface being cleaned forwardly up and onto a debris converging means comprising a mechanical debris elevator 34, which mechanical debris elevator 34 receives debris from the rotating sweeping broom 32 and deposits the debris into a debris retaining hopper 36. Alternatively, other types of debris conveying or lifting means could be used, such as is shown in FIG. 5.

In the preferred embodiment of the debris suctioning and separating apparatus 20, as illustrated, an open-bottom enclosure 40 is mounted on the surface sweeping vehicle 30 so as to generally enclose within its interior 42 the rotating sweeping broom and the mechanical debris elevator or 34. While there does not need to be complete enclosure, there needs to be at least substantial separation of the interior 42 of the enclosure 40 from the ambient surroundings, thus m making it possible to reduce the air pressure within the interior or 42 of the enclosure 40, for dust control purposes, as will be discussed in greater detail subsequently.

The open-bottom enclosure 40 has a bottom opening 44 defined by a peripheral bottom edge 48. A surface contacting skirt 46 is disposed at the bottom edge 48 of the open-bottom enclosure 40 peripherally around the bottom opening 44, so as to be in air flow precluding contact with surface 24 to be cleaned. In the preferred embodiment, as illustrated, the bottom opening 44 of the enclosure 40 is disposed at the rotating sweeping broom 32 only. In other words, the bottom opening 44 is no larger than necessary, thus making it easier to reduce the air pressure within the interior 42 of the enclosure 40.

A debris separator means preferably comprising a cyclonic separator 60, but alternatively comprising any other suitable type of dust separators having the characteristics as described henceforth, is operatively mounted the surface sweeping vehicle 30, exteriorly to the debris retaining hopper 36 and directly above the mechanical debris elevator or 34. The cyclonic separator 60 has an air inlet 52 and an air outlet 54. The air inlet 52 is in fluid communication with the interior 42 of the enclosure 40, for receiving debris-laden air into the cyclonic separator 60. A debris suctioning head 56 is integrally incorporated into the enclosure 40, and has a mouth 58 in fluid communication with the air inlet 52 of the cyclonic separator, via a hose 59, thereby permitting removal of debris-laden air from the interior 42 of the enclosure 40. In the preferred embodiment, the mouth 58 of the debris suctioning head 56 is disposed adjacent the rotating sweeping broom 32, such that dust that is stirred up by the sweeping action of sweeping broom 32 is immediately drawn up, as indicated by arrow "A" in FIG. 1. Alternatively, the mouth 58 could be located so as to draw debris-laden air from essentially anywhere within the enclosure 40.

The cyclonic separator 60 also has a dust release outlet 62 at its bottom end 64, for the controlled release of dust that has been separated and captured by the cyclonic separator 60, and is temporarily retained therein. In the preferred embodiment, as illustrated, the dust release outlet 62 is disposed within the enclosure 40 in a debris depositing relation with respect to the mechanical debris elevator 34. In other words, the dust release outlet 62 is disposed immediately over the mechanical debris elevator 34 such that any debris expelled from the cyclonic separator 60 is dropped onto the elevator 34, to be carried to the hopper 36. In this manner, dust in the debris-laden air in the 42 of the enclosure 40 is removed from the air and is ultimately retained in the hopper 36.

A fan means comprising a high capacity fan 70 is operatively mounted in fluid communication with the air outlet 54 of the cyclonic separator 60 such that the cyclonic separator 60 is operatively disposed between the fan 70 and the enclosure 40. The fan 70 draws debris-laden air from the enclosure 40 and through the cyclonic separator 60, as indicated by arrows "A" and "B" in FIG. 1, and then through a self-purging secondary air filter 72 disposed in the air outlet 54. The captured dust is deposited into the hopper 36 via the sloped chute 68 and the mechanical debris elevator 34.

The fan 70 then exhausts air into the ambient surroundings, as indicated by arrow "C", which exhaust air is substantially dust free, as the dust has been separated from it by the cyclonic separator 60 and the filter 72, thus precluding harmful dust and debris from reaching the fan 70. The fan 70 also causes reduced air pressure within the enclosure 40 so as to maintain a seal between surface contacting skirt 46 of the enclosure 40 and the surface 24 being cleaned, and also precludes dust from escaping from the enclosure 40 between the surface contacting skirt 46 and the surface 24 being cleaned.

A valve means comprising an air lock type of valve, specifically a positive sealing rotary valve 66 is operatively mounted on the cyclonic separator 60 at the dust release outlet 62, to effect the controlled flow-restricted release of the separated and captured dust from the cyclonic separator 60 onto the debris elevator 34. The positive sealing rotary valve 66 also precludes the ingress of air and debris into the cyclonic separator 60 through the dust release outlet 62.

As can be seen from the above description and drawings, the dust is separated from the debris-laden air drawn through the air inlet 52 and into the cyclonic separator 60, during the operation of the rotating sweeping broom 32 and the mechanical debris elevator 34. Debris separated by the cyclonic separator 60 is subsequently deposited onto the debris elevator 34, thereby substantially retaining dust within the enclosure 40 and precluding its escape into the atmosphere, also during the operation of the rotating sweeping broom 32 and the mechanical debris elevator 34.

Figure 2:
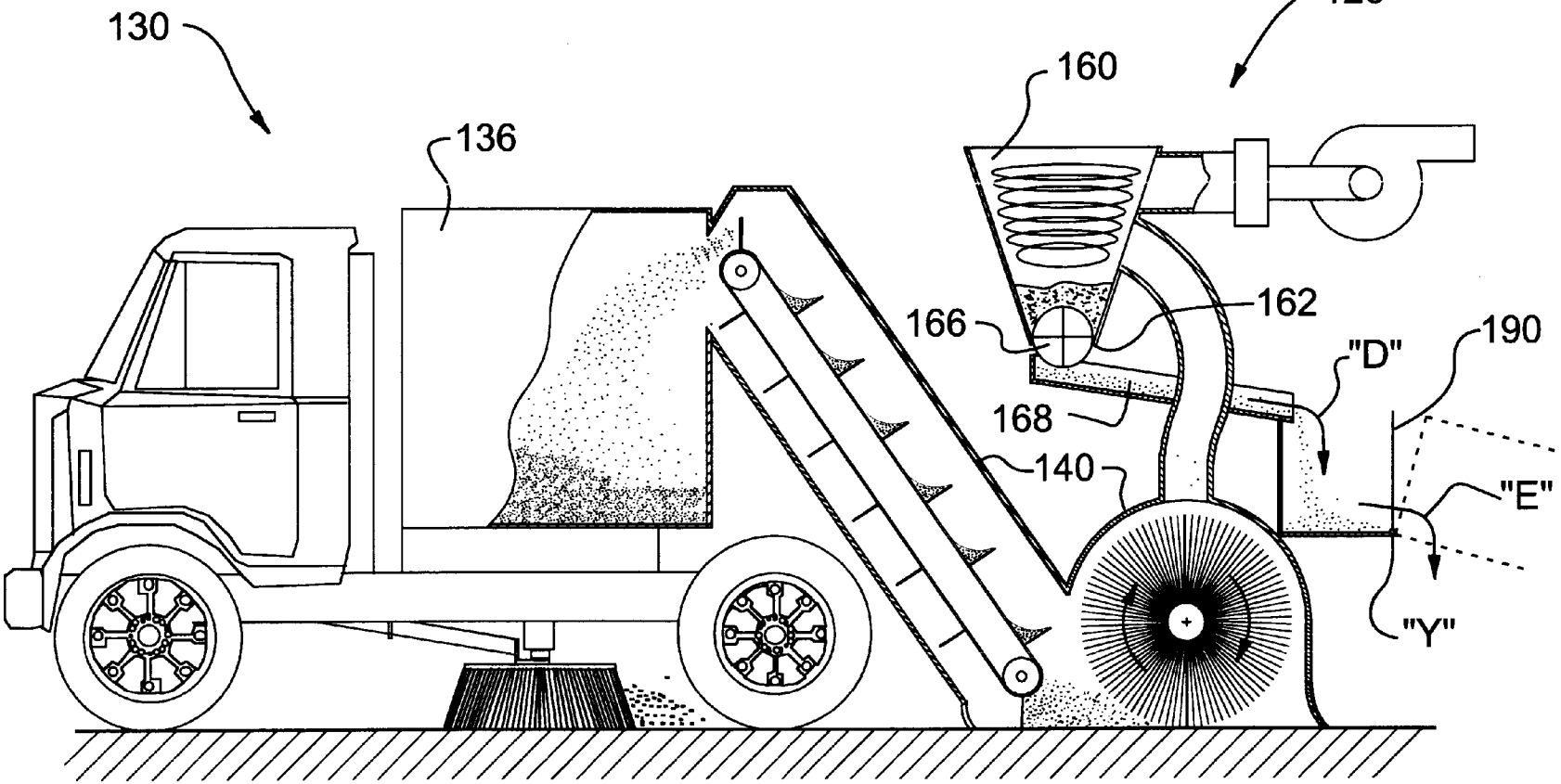
FIG. 2 is a side elevational view of a first alternative embodiment of the debris suctioning and separating apparatus according to the present invention, installed on a surface sweeping vehicle, specifically on a mechanical sweeper with a portion of the side of the surface sweeping vehicle removed for the sake of clarity.

In a first alternative embodiment, as illustrated in FIG. 2, the debris suctioning and separating apparatus of the present invention, as indicated by the general reference numeral 120, is installed on a surface sweeping vehicle indicated by the general reference numeral 130. The debris suctioning and separating apparatus 120 is similar to the preferred embodiment debris suctioning and separating apparatus 20, except that the cyclonic separator 160 is mounted such that its dust release outlet 162 is disposed externally to the enclosure shroud 140, and is disposed in debris depositing relation with respect to a debris receptacle 190. The debris receptacle 190 is mounted on the surface sweeping vehicle 130 so as to receive dust from the dust release outlet 162, as released by the positive sealing rotary valve 166, and so travels down a guide chute 168 into the dust receptacle 190, as indicated by arrow "D". The debris receptacle 190 must be emptied occasionally, typically when the hopper 136 is emptied, and accordingly is mounted for tipping about an axis "Y", as indicated by arrow "E".

Figure 3:
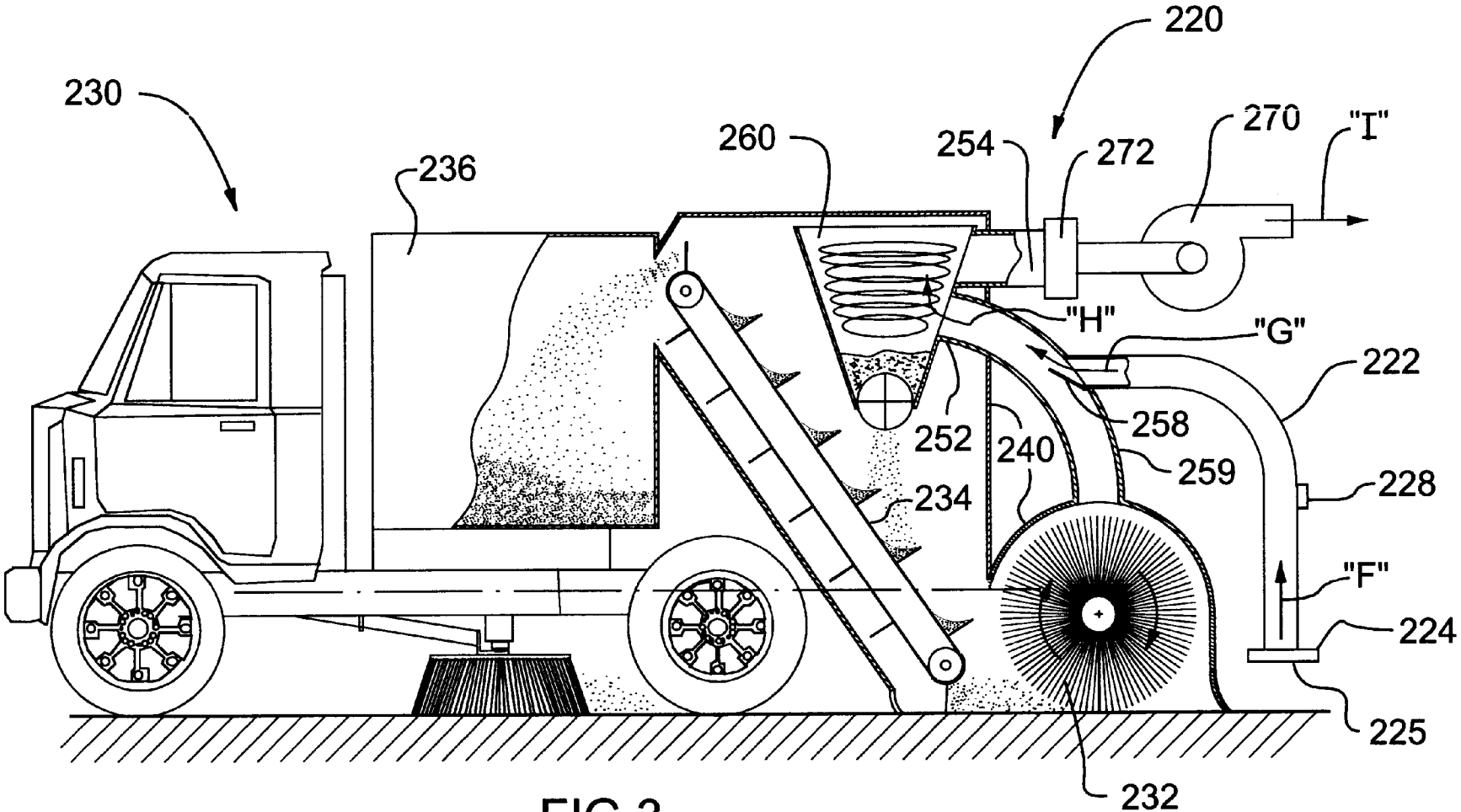
FIG. 3 is a side elevational view of a second alternative embodiment of the debris suctioning and separating apparatus according to the present invention, installed on a surface sweeping vehicle, specifically on a mechanical sweeper, with a portion of the side of the surface sweeping vehicle removed for the sake of clarity; and, FIG. 4 is a side elevational view of a third alternative embodiment of the debris suctioning and separating apparatus according to the present invention, installed on a surface sweeping vehicle, specifically on a factory sweeper, with a portion of the side of the surface sweeping vehicle removed for the sake of clarity.

In a second alternative embodiment, as illustrated in FIG. 3, the debris suctioning and separating apparatus, as indicated by the general reference numeral 220, is installed on a surface sweeping vehicle indicated by the general reference numeral 230. The debris suctioning and separating apparatus 220 has an elongate cylindrically-shaped rotating sweeping broom 232 that sweeps debris on a surface being cleaned forwardly up and onto a mechanical debris elevator 234, which mechanical debris elevator 234 receives debris from the rotating sweeping broom 232 and deposits the debris into a debris retaining hopper 236. Accordingly, the debris suctioning and separating apparatus 220 is similar to the preferred embodiment debris suctioning and separating apparatus 20, except for the addition of a flexible suction hose 222 having a debris suctioning head 224 disposed at the bottom end thereof, with the suction hose 222 mounted on the surface sweeping vehicle 230 exteriorly to the enclosure 240 and rearwardly of the rotating sweeping broom 232. The debris suctioning head 224 has a mouth 225 is in fluid communication with the cyclonic separator 260 through the suction hose 222, the suction hose 259, and the air inlet 252, so as to permit selective suctioning of debris from areas adjacent the surface sweeping vehicle 230. A fan 270 draws air upwardly from the suction head 224 and through the air hose 222, as indicated by arrow "F", and into the suction hose 259, as indicated by arrow "G". The rate at which air is drawn into the suction hose 259 is determined by a gate valve 258, as controlled by the operator of the surface sweeping vehicle 230.

The fan 270 then draws the air into the cyclonic separator 260 as indicated by arrow "H", and out of the cyclonic separator 260 through the air outlet 254, and then through the self-purging secondary air filter 272. The air is then expelled to the ambient surroundings by the fan 270, as indicated by arrow "I". A handle 228 is secured to the flexible suction hose 222 and permits manual manipulation of the flexible suction hose 222, so as to allow suctioning of debris from curb sides, gutters, catch basins, and so on, while the elongate cylindrically-shaped rotating sweeping broom 232 and the mechanical debris elevator 234 continue to operate. Accordingly, the flexible suction hose 222 can be used to fill the hopper 236, with debris, which cannot be performed by prior art surface sweeping vehicles having mechanical debris elevator.

Figure 4:
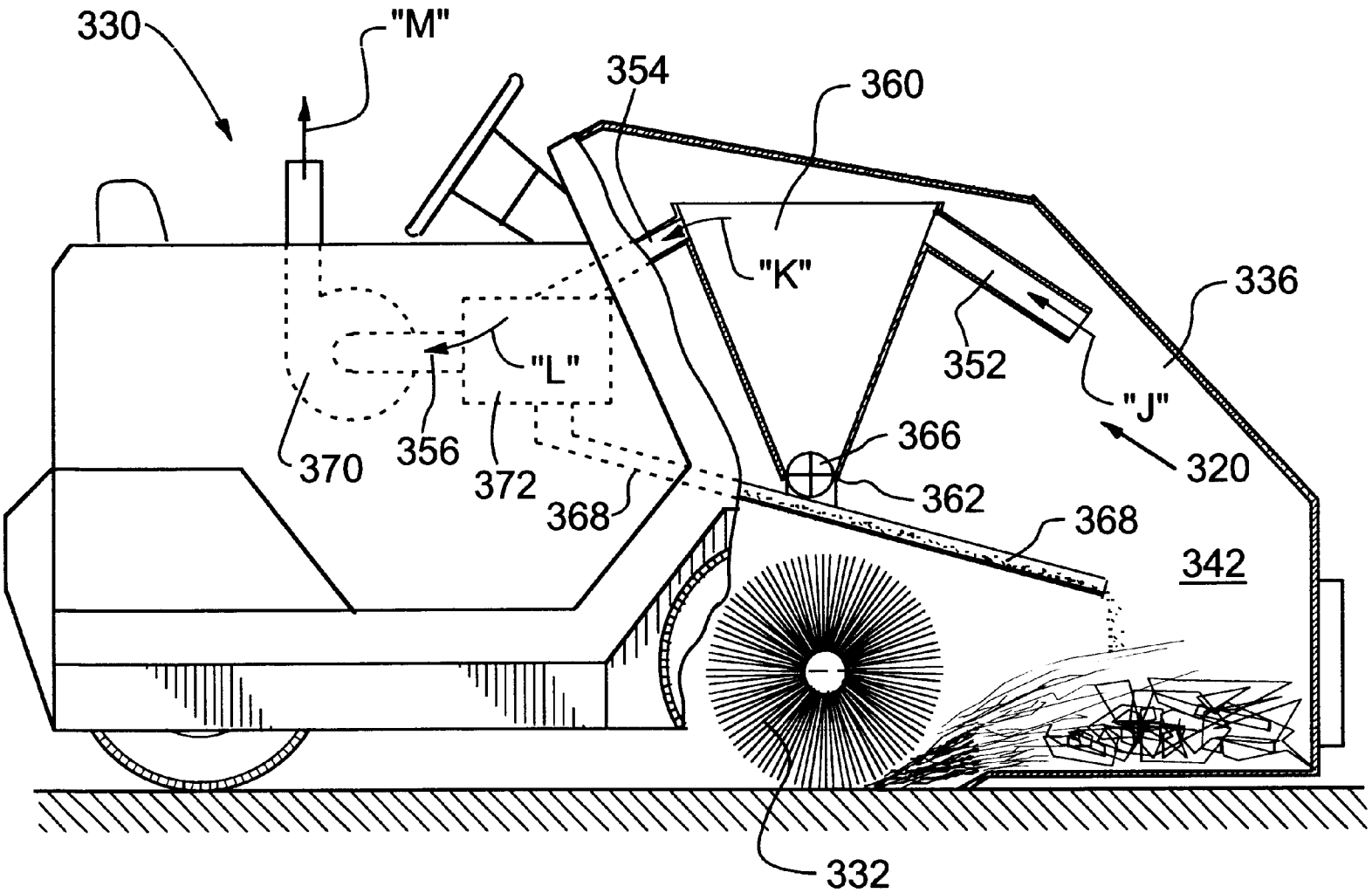

In a third alternative embodiment, as illustrated in FIG. 4, the debris suctioning and separating apparatus, as indicated by the general reference numeral 320, is installed on a surface sweeping vehicle indicated by the general reference numeral 330. The debris suctioning and separating apparatus 320 functions in a similar manner to the preferred embodiment debris suctioning and separating apparatus 20, but the surface sweeping vehicle 330 is a type commonly referred to as a factory sweeper, and does not have a debris conveying means. Instead, the surface sweeping vehicle 330 has a rotating sweeping broom 332 and a debris retaining hopper 336 to receive debris directly from the rotating sweeping broom 332.

A dust separator means, which in the third alternative embodiment as illustrated, comprises a cyclonic separator 360, has an air inlet 352 and an air outlet 354, with the air inlet 352 being in fluid communication with the interior 342 of the hopper 336 so as to permit removal of dust-laden air from the interior 342 of the hopper 336. The cyclonic separator 360 also has a dust release outlet 362 for controlled release of separated and captured dust. The dust release outlet 362 of the cyclonic separator 360 is disposed in dust depositing relation with respect to the hopper 336 via a sloped chute 368.

A fan means comprising a high capacity fan 370 is operatively mounted in fluid communication with the air outlet 354 of the cyclonic separator 360, to draw dust-laden air from the interior 342 of the hopper 336, as indicated by arrow "J", into the cyclonic separator 360, whereat the debris is separated from the air. The separated air is then drawn out of the cyclonic separator 360, as indicated by arrow "K", through a self-purging secondary air filter 372 and hose 356 to the fan 370, as indicated by arrow "L", to be exhausted into the ambient surroundings by the fan 370 as clean air having dust substantially separated therefrom, as indicated by arrow "M". The secondary air filter 372 captures the small amount of dust that might pass through the cyclonic separator 360, and is a self-purging type of filter. The captured dust is deposited into the hopper 336 via the sloped chute 368.

A valve means comprising an air lock type of valve, specifically a positive sealing rotary valve 366, is operatively mounted on the cyclonic separator 360 at the dust release outlet 362, to effect the controlled flow-restricted release from the cyclonic separator 360 of the separated and captured dust, and to preclude the ingress of air and dust into the cyclonic separator 360 through the dust release outlet 362. Dust is separated from the dust-laden air drawn from the interior 342 of the hopper 336, thereby substantially precluding the escape of dust into the atmosphere.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims.

I claim:

1. A debris auctioning and separating apparatus for use in a surface sweeping vehicle having a cylindrically-shaped rotating sweeping broom that propels debris forwardly and a hopper to receive and retain said debris, said debris suctioning and separating apparatus comprising:

debris separator means mounted on said surface sweeping vehicle and having an air inlet for receiving debris-laden air created by said sweeping broom into said debris separator means, an air outlet for exhausting separated air from said debris separator means, and a debris release outlet for selectively releasing separated debris from said debris separator means;

fan means operatively mounted at said air outlet of said debris separator means, to draw said debris-laden air through said air inlet and into said debris separator means, and to exhaust separated air from said debris separator means to ambient surroundings;

valve means operatively mounted on the debris separator means at said debris release outlet, to effect the controlled flow restricted release from said debris separator means of the separated and captured debris, and to preclude the ingress of air and debris into said debris separator means through said debris release outlet;

wherein debris is separated from said debris-laden air drawn through said air inlet and into said debris separator means, during the operation of cylindrically-shaped rotating sweeping broom.

2. The debris suctioning and separating apparatus of claim 1, wherein said debris separator means comprises a cyclonic separator.

3. The debris suctioning and separating apparatus of claim 2, wherein said debris release outlet of said debris separator means is disposed in debris depositing relation with respect to a debris elevating means.

4. The debris suctioning and separating apparatus of claim 2, wherein said debris release outlet of said debris separator means is disposed in debris depositing relation with respect to a debris receptacle.

5. The debris suctioning and separating apparatus of claim 1, wherein said debris release outlet of said debris separator means is disposed in debris depositing relation with respect to said hopper.

6. The debris suctioning and separating apparatus of claim 1, further comprising a debris suctioning head having a mouth in fluid communication with said air inlet of said debris separator means.

7. The debris suctioning and separating apparatus of claim 6, wherein said surface sweeping vehicle includes an enclosure that generally encloses said rotating sweeping broom, and said hopper, and wherein said mouth of said debris suctioning head is disposed within said enclosure.

8. The debris suctioning and separating apparatus of claim 7, wherein said debris suctioning head is disposed exteriorly to said enclosure and is in fluid communication with said air inlet, as foresaid, through a suction hose, so as to permit selective suctioning of debris from areas adjacent said surface sweeping vehicle.

9. The debris suctioning and separating apparatus of claim 1, wherein said debris separator means is mounted exteriorly to said hopper.

10. A debris suctioning and separating apparatus for use in a surface sweeping vehicle having a cylindrically-shaped rotating sweeping broom that propels debris forwardly, a debris receiving and retaining hopper, and a debris conveying means to receive debris from said cylindrically-shaped rotating sweeping broom and convey it to said hopper, said debris suctioning and separating apparatus comprising:

debris separator means mounted on said surface sweeping vehicle and having an air inlet for receiving debris-laden air created by said sweeping broom into said debris separator means, an air outlet for exhausting separated air from said debris separator means, and a debris release outlet for selectively releasing separated debris from said debris separator means;

fan means operatively mounted at said air outlet of said debris separator means, to draw said debris-laden air through said air inlet and into said debris separator means, and to exhaust separated air from said debris separator means to ambient surroundings;

valve means operatively mounted on the debris separator means at said debris release outlet, to effect the controlled flow-restricted release from said debris separator means of the separated and captured debris, and to preclude the ingress of air and debris into said debris separator means through said debris release outlet;

wherein debris is separated from said debris-laden air drawn through said air inlet and into said debris separator means, during the operation of said cylindrically-shaped rotating sweeping broom and the debris conveying means.

11. A debris suctioning and separating apparatus for use in a surface sweeping vehicle having cylindrically-shaped rotating sweeping broom that propels debris forwardly, a debris receiving and retaining hopper, and a debris conveying means to receive debris from said cylindrically-shaped rotating sweeping broom and convey it to said hopper, said debris suctioning and separating apparatus comprising:

debris separator means mounted on said surface sweeping vehicle exteriorly to said hopper and having an air inlet for receiving debris-laden air created by said sweeping broom into said debris separator means, an air outlet for exhausting separated air from said debris separator means, and means for selectively releasing separated debris from said debris separator means;

fan means operatively mounted at said air outlet of said debris separator means, to draw said debris-laden air through said air inlet and into said debris separator means, and to exhaust said separated air from said debris separator means to ambient surroundings;

wherein debris is separated from said debris-laden air during the operation of said cylindrically-shaped rotating sweeping broom and the debris conveying means.

12. The debris auctioning and separating apparatus of claim 10, wherein said debris separator means comprises a cyclonic separator.

13. The debris suctioning and separating apparatus of claim 10, wherein said debris release outlet of said debris separator means is disposed in debris depositing relation with respect to said debris conveying means.

14. The debris suctioning and separating apparatus of claim 10, wherein said debris release outlet of said debris separator means is disposed in debris depositing relation with respect to a debris receptacle.

15. The debris suctioning and separating apparatus of claim 10, wherein said debris release outlet of said debris separator means is disposed in debris depositing relation with respect to said hopper.

16. The debris suctioning and separating apparatus of claim 10, further comprising a debris suctioning head having a mouth in fluid communication with said air inlet of said debris separator means.

17. The debris suctioning and separating apparatus of claim 16, wherein said surface sweeping vehicle includes an enclosure that generally encloses said rotating sweeping broom, said debris conveying means, and said hopper, and wherein said mouth of said debris auctioning head is disposed within said enclosure.

18. The debris suctioning and separating apparatus of claim 16, wherein said debris auctioning head is disposed exteriorly to said enclosure and is in fluid communication with said air inlet, through a suction hose, so as to permit selective suctioning of debris from areas adjacent said surface sweeping vehicle.

19. The debris suctioning and separating apparatus of claim 18, wherein said debris release outlet is disposed in debris depositing relation with respect to a debris receptacle.

20. The debris suctioning and separating apparatus of claim 10, wherein said debris conveying means comprises a mechanical debris elevator.

21. The debris auctioning and separating apparatus of claim 11, wherein said means for selectively releasing separated debris from said debris separator means comprises a debris release outlet.

22. The debris suctioning and separating apparatus of claim 21, further comprising a valve means operatively mounted on the debris separator means at said debris release outlet, to effect the controlled flow-restricted release from said debris separator means of the separated and captured debris, and to preclude the ingress of air and debris into said debris separator means through said debris release outlet.

23. The debris suctioning and separating apparatus of claim 21, wherein said debris release outlet is disposed in debris depositing relation with respect to said debris conveying means.

24. The debris suctioning and separating apparatus of claim 11, further comprising a debris auctioning head having a mouth in fluid communication with said air inlet of said debris separator means.

25. The debris suctioning and separating apparatus of claim 24, wherein said surface sweeping vehicle includes an enclosure that generally encloses said rotating sweeping broom, said debris conveying means, and said hopper, and wherein said mouth of said debris auctioning head is disposed within said enclosure.

26. The debris auctioning and separating apparatus of claim 25, wherein said debris auctioning head is disposed exteriorly to said enclosure and is in fluid communication with said air inlet, as foresaid, through a suction hose, so as to permit selective auctioning of debris from areas adjacent said surface sweeping vehicle.

27. The debris suctioning and separating apparatus of claim 11, wherein said debris conveying means comprises a mechanical debris elevator.

28. The debris suctioning and separating apparatus of claim 11, wherein said debris separator means comprises a cyclonic separator.

* * * * *